US007152587B2

(12) United States Patent
Suzuki

(10) Patent No.: US 7,152,587 B2
(45) Date of Patent: Dec. 26, 2006

(54) EVAPORATED FUEL TREATMENT DEVICE OF INTERNAL COMBUSTION ENGINE AND EVAPORATED FUEL TREATMENT METHOD

(75) Inventor: Naoto Suzuki, Fujinomiya (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/248,570

(22) Filed: Oct. 13, 2005

(65) Prior Publication Data

US 2006/0086343 A1 Apr. 27, 2006

(30) Foreign Application Priority Data

Oct. 25, 2004 (JP) ..... 2004-309313

(51) Int. Cl.
*F02M 33/02* (2006.01)
*F02M 1/00* (2006.01)

(52) U.S. Cl. ..... 123/518; 123/520

(58) Field of Classification Search ..... 123/518, 123/519, 520, 521, 198 D; 73/118.1
See application file for complete search history.

(56) References Cited

U.S. PATENT DOCUMENTS

| | | | | |
|---|---|---|---|---|
| 5,284,050 | A * | 2/1994 | Iida et al. | 73/118.1 |
| 5,419,299 | A * | 5/1995 | Fukasawa et al. | 123/520 |
| 6,192,742 | B1 * | 2/2001 | Miwa et al. | 73/40 |
| 6,367,459 | B1 * | 4/2002 | Yoshioka et al. | 123/520 |
| 6,634,343 | B1 * | 10/2003 | Kano et al. | 123/520 |
| 6,761,154 | B1 * | 7/2004 | Takagi et al. | 123/520 |

FOREIGN PATENT DOCUMENTS

| | | |
|---|---|---|
| JP | A 2004-156492 | 6/2004 |
| JP | A 2004-156493 | 6/2004 |
| JP | A 2004-156495 | 6/2004 |
| JP | A 2004-156499 | 6/2004 |

* cited by examiner

*Primary Examiner*—John T. Kwon
(74) *Attorney, Agent, or Firm*—Oliff & Berridge, PLC

(57) ABSTRACT

In a canister system of seal type, a purge VSV is closed even if a predetermined purge condition is established so as to prevent direct purging of an evaporated fuel within a fuel tank into an intake system of an engine when one of the following conditions is established, that is, (1) a motor pump of an OBD pump module is driven; (2) a switching valve of the OBD pump module is set to ON; and (3) a closing valve is opened.

9 Claims, 4 Drawing Sheets

EVAPORATED FUEL TREATMENT DEVICE OF INTERNAL COMBUSTION ENGINE AND EVAPORATED FUEL TREATMENT METHOD

INCORPORATION BY REFERENCE

The disclosure of Japanese Patent Application No. 2004-309313 filed on Oct. 21, 2004 including the specification, drawings and abstract is incorporated herein by reference in its entirety.

BACKGROUND OF THE INVENTION

1. Field of the Invention

The invention relates to an evaporated fuel treatment device and an evaporated fuel treatment method for treating an evaporated fuel generated within a fuel tank (for example, a fuel tank for a vehicle) without discharging the evaporated fuel to the atmosphere. More specifically, the invention relates to elimination of the failure resulting from direct introduction of the evaporated fuel within the fuel tank into an intake system of an internal combustion engine.

2. Description of the Related Art

A canister system (evaporated fuel treatment device) for preventing discharge of the evaporated fuel generated within the fuel tank into the atmosphere is well known as being provided for the fuel supply system in an engine for a vehicle. For example, such publications as JP-A-2004-156495 and JP-A-2004-156492 disclose the canister system in which the evaporated fuel generated within the fuel tank is temporarily adsorbed in a charcoal canister (hereinafter simply referred to as a canister) such that the evaporated fuel within the canister is introduced (purged) into an intake pipe of the engine under the negative pressure of the intake air in the intake system of the engine upon establishment of a predetermined purge condition.

The canister system disclosed in the above described publications is provided with a vapor pipe that connects the fuel tank with the canister, a purge pipe that connects the canister with the intake pipe of the engine, and an atmospheric introduction pipe that communicates the atmosphere with the inside of the canister.

The vapor pipe is provided with a closing valve unit that is capable of cutting the communication between the fuel tank and the canister. The closing valve unit includes a closing valve as an electromagnetic valve which is capable of switching between an opened state and a closed state, and a relief valve connected in parallel with the closing valve. The purge pipe includes a purge control valve (hereinafter referred to as a purge VSV) as an electrically operated valve or a motor valve for controlling a flow rate of the evaporated fuel flowing to the intake pipe. The atmospheric introduction pipe includes an OBD (On-Board Diagnostic System) pump module for controlling introduction of the atmospheric pressure into the canister. The OBD pump module includes a switching valve that switches the communication state of the atmospheric pressure with the canister between a communication state and a non-communication state, and a motor pump for applying the negative pressure into the canister system during the failure diagnosis.

JP-A-2004-156495 discloses that the purge VSV is forcibly closed upon supply of the fuel into the fuel tank during the engine operation. This makes it possible to prevent direct purging of the evaporated fuel into the engine intake system from the purge pipe so as not to bring the engine into the unstable operation state even if the closing valve is opened so as to prevent discharge of the evaporated fuel generated within the fuel tank into the atmosphere from the feed pipe.

In the above-described canister system, when a failure, for example, hole, crack, or poor sealing occurs in the fuel tank, the canister, or the like, the evaporated fuel may leak out of the portion at which such failure occurs. In the case where error occurs in the assembly of the pipe during the process of manufacturing the vehicle, the evaporated fuel may also leak to the outside. It is therefore important for the canister system of the aforementioned type to immediately locate the portion that causes the leakage of the evaporated fuel. For this, the engine is operated to apply the negative pressure of the intake air in the intake system to the canister system such that it is diagnosed whether there exists a position that causes the leakage of the evaporated fuel based on the introduced negative pressure. As the negative pressure of intake air tends to take a relatively high value, the above-described diagnosis may be performed for a shorter period.

Generally a failure diagnosis tool is connected to a controller (ECU) for controlling the aforementioned valves and the motor pumps such that a failure diagnosis signal is sent from the failure diagnosis tool to the controller. Upon receipt of such signal, the controller performs the failure diagnosis (determines whether there is a failure point that causes the leakage of the evaporated fuel, diagnoses operations of the valves and motor pumps) while operating those valves and pumps in accordance with the predetermined procedure.

In the case where the position of the switching valve of the OBD pump module is forcibly switched from OFF to ON upon diagnosis of the operation of the OBD pump module, the introduction of the atmospheric pressure into the canister is cut. Meanwhile during the engine operation, the purge control is normally executed. Accordingly when a predetermined purge condition is established, the purge VSV is expected to be opened. When the purge condition is established in a state where the introduction of the atmospheric pressure into the canister is cut by forcibly switching the position of the switching valve of the OBD pump module from OFF to ON as described above, the negative pressure of intake air in the intake system is introduced into the canister as the purge VSV is opened. The pressure within the canister becomes considerably lower than the pressure within the fuel tank. The resultant differential pressure serves to open the relief valve of the closing valve unit, and as a result, the evaporated fuel within the fuel tank is directly purged into the intake system of the engine. In the aforementioned state, the density of the fuel in the mixture becomes excessively high to bring the engine into the unstable operation state, and as the case may be, the engine operation is stopped.

The aforementioned failure may occur not only in the case of forcibly switching the position of the switching valve for diagnosing the operation of the OBD pump module but also in the case of switching the position of the switching valve caused by the operation error.

Further the aforementioned failure may occur not only in the case of switching the position of the switching valve of the OBD pump module but also in the case of forcibly or erroneously driving the motor pump of the OBD pump module, and forcibly or erroneously opening the closing valve.

SUMMARY OF THE INVENTION

It is an object of the invention to provide an evaporated fuel treatment device and an evaporated fuel treatment method capable of bringing an internal combustion engine into a stable operation state while avoiding the case where the evaporated fuel within the fuel tank is directly purged into the intake system of the engine even if the canister system is operated during the engine operation.

According to a first aspect of the invention, an evaporated fuel treatment device of an internal combustion engine includes an evaporated fuel introduction passage through which an evaporated fuel generated within a fuel tank is introduced into an intake system of the internal combustion engine, a relief valve that is opened when an internal pressure of the fuel tank becomes higher than an internal pressure of the evaporated fuel introduction passage by a predetermined value or greater so as to allow the evaporated fuel within the fuel tank to be introduced into the evaporated fuel introduction passage, a diagnosis module capable of switching between a communication state in which the evaporated fuel introduction passage is communicated with an atmosphere and a non-communication state in which the evaporated fuel introduction passage is not communicated with the atmosphere, and a purge control valve that is opened so as to allow the evaporated fuel to be introduced into the intake system of the internal combustion engine. The evaporated fuel treatment device further includes a controller that opens the purge control valve when a predetermined purge condition is established during an operation of the internal combustion engine. The controller prohibits the purge control valve from opening so as to be in a closed state when a switching operation of the diagnosis module is performed during the operation of the internal combustion engine.

The switching operation of the diagnosis module has two types. Firstly the diagnosis module is provided with a switching valve capable of switching the communication state of the evaporated fuel introduction passage with the atmosphere between a communication state and a non-communication state. The controller may be structured to close the purge control valve by prohibiting the purge control valve from opening when the switching valve is switched from the communication state to the non-communication state. Secondly the diagnosis module is provided with a pump that is driven to introduce the negative pressure into the evaporated fuel introduction passage. The controller may be structured to close the purge control valve by prohibiting the purge control valve from opening when the operation of the pump is switched from the stopped state to the driven state.

According to the first aspect of the invention, when the predetermined purge condition is established during the engine operation, the purge control valve is normally opened. Then the evaporated fuel that has been collected within the evaporated fuel introduction passage (for example, the evaporated fuel adsorbed in the canister) is introduced into the intake system under the negative pressure of the intake air in the engine. The evaporated fuel is treated so as to prevent discharge of the evaporated fuel from the fuel tank into the atmosphere.

When the operation of the diagnosis module is switched under the purge control (the position of the switching valve is switched into the non-communication state in which the evaporated fuel introduction passage is not communicated with the atmosphere, or the operation of the pump is switched from the stopped state to the driven state), the internal pressure of the evaporated fuel introduction passage drops, and the internal pressure of the fuel tank becomes relatively high. The resultant differential pressure serves to open the relief valve which may cause the evaporated fuel within the fuel tank to be directly introduced into the intake system. More specifically, in the state where the diagnosis is performed using the negative pressure of the intake air in the intake system of the engine, it may be assumed that the operation error of the switching valve or the pump causes the internal pressure of the evaporated fuel introduction passage to be decreased. The first aspect of the invention may be structured to prevent direct introduction of the evaporated fuel within the fuel tank into the intake system. The fuel density of the mixture is not excessively increased, and as a result, the stable operation state of the internal combustion engine may be held. Even if the operation error occurs in the switching valve or the pump as aforementioned, the internal combustion engine is not brought into the unstable state.

In the case where the purge control valve is prohibited from opening upon switching operation of the diagnosis module, the evaporated fuel introduction passage may be structured such that a canister that is capable of adsorbing the evaporated fuel is provided for the evaporated fuel treatment device. The canister may be connected to the fuel tank via the vapor passage, and to the intake system of the engine via the purge passage so as to be communicated with the atmosphere via the atmospheric introduction passage. It may be structured such that the relief valve is provided in the vapor passage, the purge control valve is provided in the purge passage, and the diagnosis module is provided in the atmospheric introduction passage, respectively.

According to the second aspect of the invention, an evaporated fuel treatment device of an internal combustion engine includes an evaporated fuel introduction passage through which an evaporated fuel generated within a fuel tank is introduced into an intake system of the internal combustion engine, a closing valve that is opened to allow the evaporated fuel within the fuel tank to be introduced into the evaporated fuel introduction passage, a purge control valve that is opened so as to allow the evaporated fuel to be introduced into the intake system of the internal combustion engine. The evaporated fuel treatment device further includes a controller that opens the purge control valve when a predetermined purge condition is established during an operation of the internal combustion engine. The controller prohibits the purge control valve from opening so as to be in a closed state when the closing valve is switched from a closed state to an opened state upon diagnosis performed under a negative pressure of an intake air from the intake system during an operation of the internal combustion engine.

In the second aspect of the invention, the evaporated fuel is treated under the purge control as described above so as to prevent discharge of the evaporated fuel from the fuel tank to the atmosphere. When the closing valve is switched from the closed state to the opened state under the purge control, if the internal pressure in the evaporated fuel introduction passage is lower than that in the fuel tank, the resultant differential pressure may directly introduce the evaporated fuel within the fuel tank into the intake system. More specifically, it may be assumed that the operation error occurs in the closing valve to be brought into the opened state when the diagnosis is performed under the negative pressure of the intake air in the intake system of the engine. In the second aspect of the invention, the purge control valve is prohibited from opening so as to in the closed state upon switching operation of the closing valve. Accordingly the stable operation state of the engine may be held. Even in the case where the operation error occurs in the closing valve as described above, the operation state of the engine may be prevented from becoming unstable.

In the case where the purge control valve is prohibited from opening upon opening of the closing valve, the evaporated fuel introduction passage may be structured such that a canister that is capable of adsorbing the evaporated fuel is provided for the evaporated fuel treatment device. The canister may be connected to the fuel tank via the vapor passage, and to the intake system of the engine via the purge passage. It may be structured such that the closing valve is provided in the vapor passage, and the purge control valve is provided in the purge passage, respectively.

According to the second aspect of the invention, when the operation of the diagnosis module is operated for switching during the engine operation, or the closing valve is switched from the closed state to the opened state upon diagnosis using the negative pressure of the intake air from the intake system under the engine operation, the purge control valve is prohibited from opening so as to be in the closed state. This makes it possible to prevent direct introduction of the evaporated fuel within the fuel tank into the intake system of the engine. As a result, this may avoid excessive increase in the fuel density of the mixture, thus holding the stable operation state of the engine.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
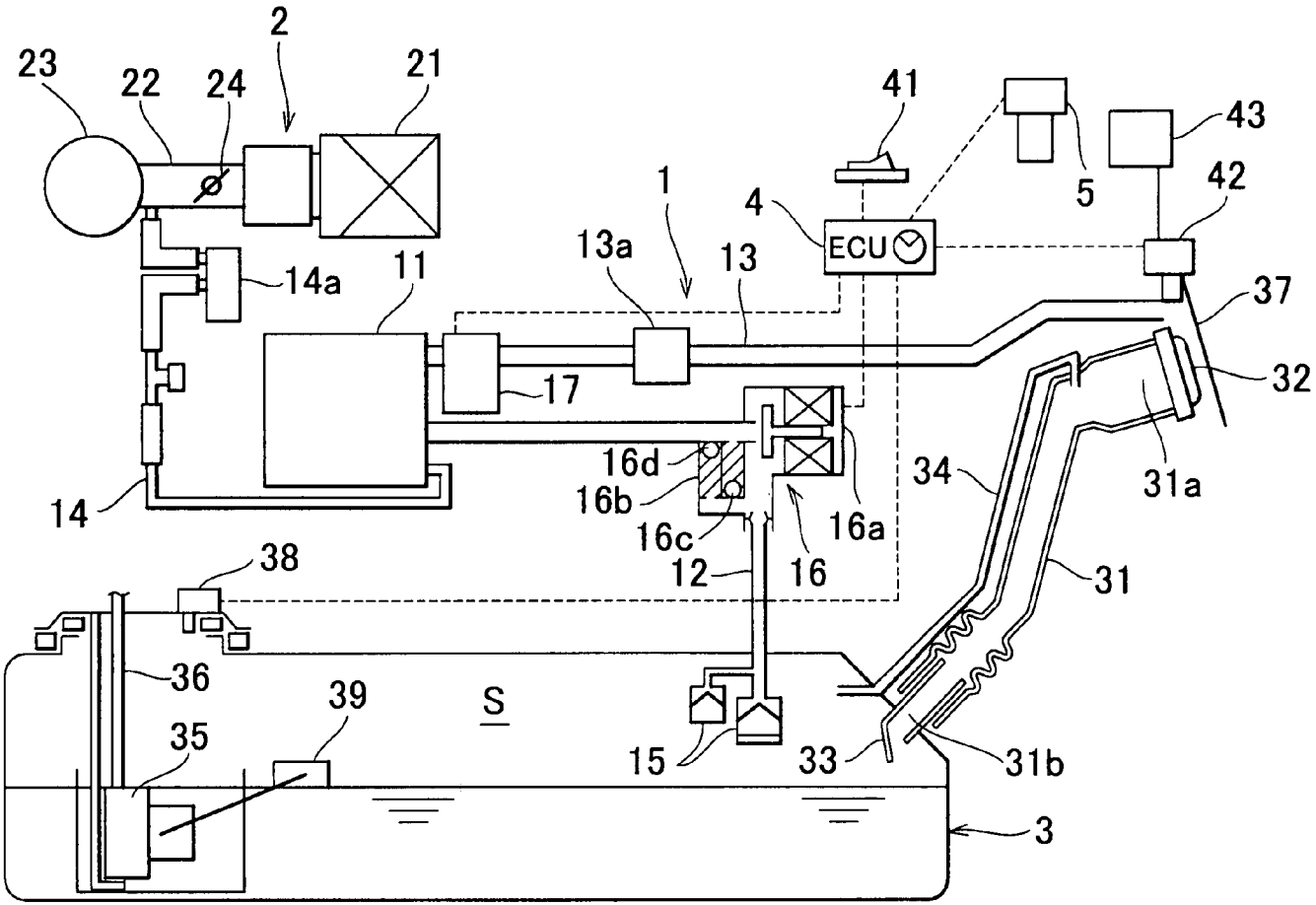
FIG. 1 is a view that schematically illustrates the structure of a canister system and an intake system of the engine to which the canister system is connected.

An embodiment of the invention will be described referring to the drawings. In this embodiment, the invention is applied to the canister system of seal type which functions as the evaporated fuel treatment device.

FIG. 1 schematically shows a structure of a canister system 1 according to the embodiment and an intake system 2 of the engine to which the canister system 1 is connected.

Structure of Intake System 2 and Fuel Tank 3

Referring to FIG. 1, an intake system 2 of an engine (internal combustion engine) is provided with an air cleaner 21, an intake pipe 22, a surge tank 23, and a not-shown intake manifold in the order from the upstream side in the direction of the intake air flow. A throttle valve 24 is provided within the intake pipe 22. The intake manifold is provided with a not-shown fuel injection valve (injector).

A fuel tank 3 that stores a fuel to be supplied to the injector is formed of, for example, a synthetic resin material, to which a feed pipe 31 is attached. A fuel cap 32 is fit with an inlet 31*a* of the feed pipe 31, and a check valve 33 is provided in an opening 31*b* of the feed pipe 31 at the side of the fuel tank. A portion in the vicinity of the inlet 31*a* of the feed pipe 31 is connected to the upper space S of the fuel tank 3 via a circulation pipe 34. A fuel pump 35 is provided within the fuel tank 3 such that the fuel pump 35 is connected to the injector via a feed pipe 36. This makes it possible to cause the fuel that has been supplied under pressure by driving the fuel pump 35 to be injected into the respective combustion chambers through the injector. An in-tank internal pressure sensor 38 that detects the pressure in the upper space S within the fuel tank 3 disposed on its upper surface, and a fluid level sensor 39 that detects the level of the stored fuel are provided within the fuel tank 3.

Structure of Canister System 1

The canister system 1 is provided with a canister 11 for collecting the evaporated fuel. The canister 11 formed as a tubular container made of a metallic or synthetic resin material is filled with an adsorbent such as an activated charcoal therein. The fuel vapor generated within the fuel tank 3 is adsorbed therein so as not to be discharged to the atmosphere. The canister 11 is further connected to a vapor pipe 12, an atmospheric introduction pipe 13, and a purge pipe 14, respectively. Each of the above-described pipes will be described hereinafter.

The vapor pipe 12 serves to introduce the fuel vapor generated within the fuel tank 3 into the canister 11. The top end of the vapor pipe 12 is opened at a position upward of the fuel level within the fuel tank 3. A ROV (Roll Over Valve) 15 is attached to the opened end for preventing the inflow of the fuel at liquid phase.

The vapor pipe 12 is provided with a closing valve unit 16 which includes a closing valve 16*a* and a relief valve 16*b*. The closing valve 16*a* is formed as an electromagnetic valve that is normally closed when electric current is not applied, and opened when the electric current is applied. The communication between the fuel tank 3 and the canister 11 is cut when the closing valve 16*a* is closed (in the non-communication state). Meanwhile, the communication between the fuel tank 3 and the canister 11 is allowed via the vapor pipe 12 when the closing valve 16*a* is opened. In the state where the closing valve 16*a* is opened, the evaporated fuel within the fuel tank 3 is allowed to be introduced into the canister 11.

The relief valve 16*b* includes a forward relief valve 16*c* and a reverse relief valve 16*d*. The forward relief valve 16*c* is opened when the pressure within the fuel tank 3 becomes considerably higher (for example, 20 kPa or higher) than that within the canister 11 such that the evaporated fuel within the fuel tank 3 is introduced into the canister 11. Meanwhile the reverse relief valve 16*d* is opened when the pressure within the fuel tank 3 becomes considerably lower (for example, the pressure difference becomes 15 kPa or higher) than that within the canister 11 such that the pressure at the side of the canister 11 is supplied into the fuel tank 3. The value of the differential pressure, based on which the relief valve 16*b* is opened is not limited to the one as described above.

The atmospheric introduction pipe 13 serves to communicate the canister 11 with the atmosphere, having one end opened in the vicinity of a fuel lid 37 provided around the inlet 31*a* of the feed pipe 31. An OBD (On-Board Diagnostic System) pump module (diagnostic module) 17 is provided in the atmospheric introduction pipe 13 at an intermediate position.

Figure 2A:
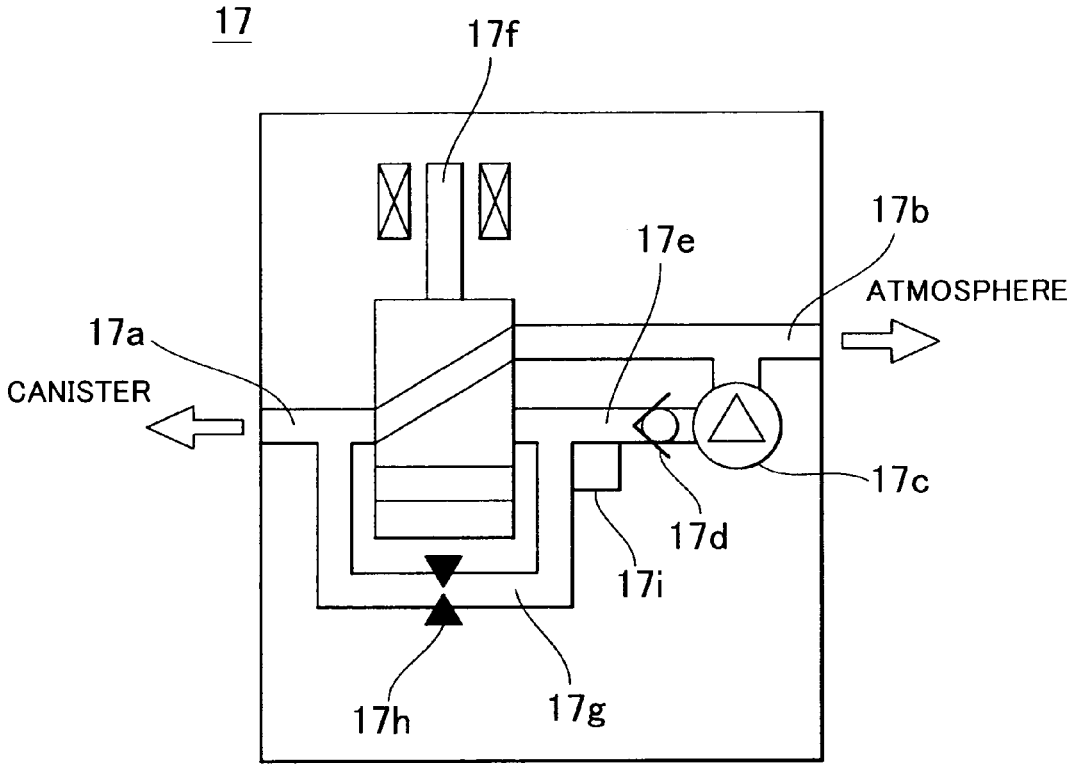
FIGS. 2A and 2B are schematic views of an OBD pump module, FIG. 2A representing OFF state of the switching valve, and FIG. 2B representing ON state of the switching valve, respectively.
Figure 2B:
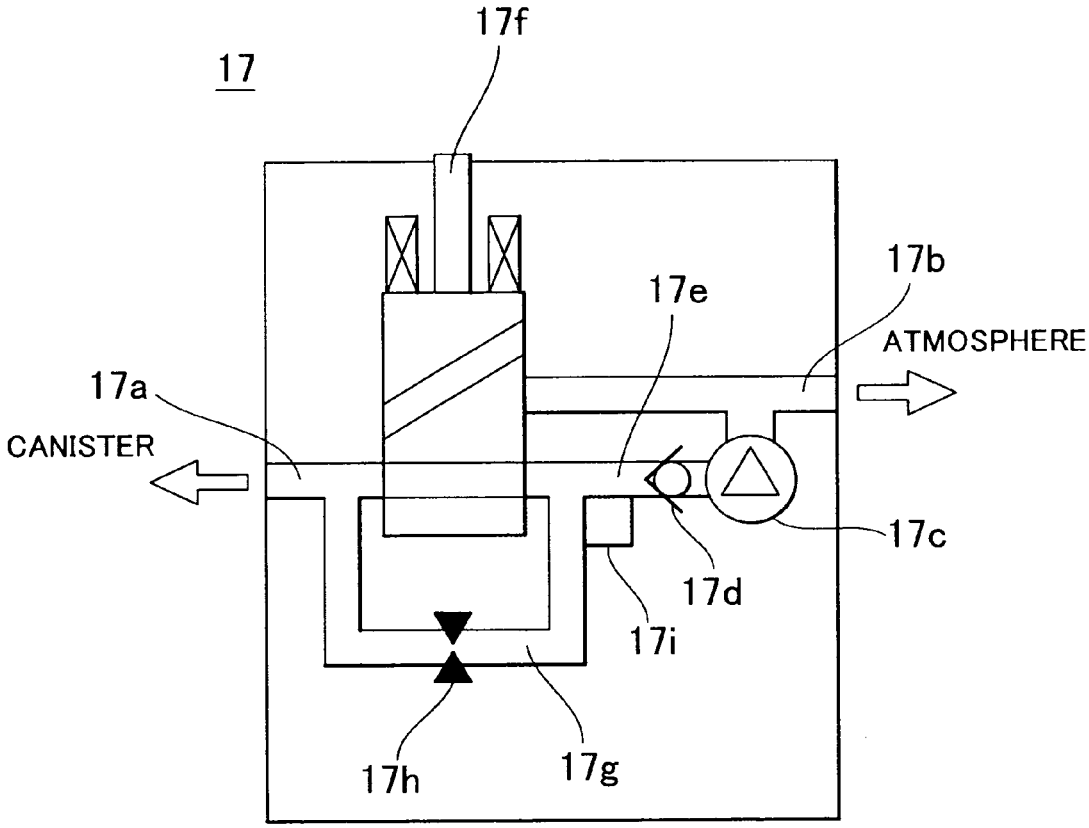

As shown in FIGS. 2A and 2B, the OBD pump module 17 includes a passage 17*a* that is communicated with the inside of the canister 11, and a passage 17*b* that is communicated with the atmosphere. The passage 17*b* at the atmospheric side is connected to a pump passage 17*e* that includes an electrically operated pump 17*c* and a check valve 17*d*. The motor pump 17*c* serves to introduce the negative pressure into the canister system 1 during the failure diagnosis with respect to the canister system 1. The OBD pump module 17 is provided with a switching valve 17*f* and a bypass passage 17*g*. The switching valve 17*f* serves to communicate the passage 17*a* with the passage 17*b* when the current is not applied (OFF state as shown in FIG. 2A), and serves to communicate the passage 17*a* with the pump passage 17*e* when the current is applied, that is, ON state as shown in FIG. 2B. The bypass passage 17*g* serves to communicate the passage 17*a* with the pump passage 17*e*, having a reference orifice 17*h* with a diameter of 0.5 mm formed at the intermediate position. The reference orifice 17*h* is formed so as to obtain the reference pressure value on the assumption that the hole with a diameter of 0.5 mm is formed in the pipe when, for example, the failure diagnosis is performed with respect to the canister system 1 while the engine operation is stopped. A pump module pressure sensor 17*i* is built in the OBD pump module 17, which allows the pressure within the pump passage 17*e* to be detected at the check valve 17*d* at the side of the switching valve 17*f*.

A dust-proof filter 13*a* is provided in the atmospheric introduction filter 13 at a position closer to the atmospheric side than the OBD pump module 17.

The purge pipe 14 serves to introduce the evaporated fuel that has been adsorbed in the canister 11 into the intake pipe 22, having one end connected to the upstream side of the surge tank 23. A purge VSV (purge control valve) 14*a* formed as an electrically operated valve capable of adjusting its opening degree is provided in the purge pipe 14 at the intermediate position. The purge VSV 14*a* that is normally closed is opened at a timing when a predetermined purge condition is established during the engine operation. This may allow the negative pressure within the intake passage 22 to be applied into the canister 11.

The OBD pump module 17 is switched to OFF and the purge VSV 14*a* is opened in the state where the evaporated fuel is adsorbed and held within the canister 11. Then the negative pressure within the intake pipe 22 is applied into the canister 11, and air is introduced from the atmospheric introduction pipe 13 into the canister 11 such that the evaporated fuel within the canister 11 is introduced into the intake pipe 22 together with air via the purge pipe 14. The evaporated fuel can be treated as described above.

The purge VSV 14*a* serves as the VSV (Vacuum Switching Valve) for controlling the flow rate of the evaporated fuel flowing into the intake pipe 22, and has its opening degree adjusted under the duty control such that the flow rate of the evaporated fuel supplied into the intake pipe 22 is adjusted.

The evaporated fuel introduction passage through which the evaporated fuel within the tank is introduced into the intake system of the engine is formed of the canister 11 and the purge pipe 14 at the portion downstream of the closing valve unit 16 provided for the vapor pipe 12.

The canister system 1 according to the embodiment is provided with an ECU 4 which has a soak timer built therein for counting the time passage in a parking state of the vehicle. The ECU 4 is connected to a lid switch 41 and a lid opener operation switch 42 in addition to the aforementioned tank internal pressure sensor 38, the closing valve 16*a*, and the OBD pump module 17. The lid opener operation switch 42 is linked with a lid manual operation device 43 via a wire.

The lid switch 41 is a momentary switch that generates an ON signal momentarily when it is operated by a user. The lid opener operation switch 42 is structured to hold the fuel lid 37 that covers the inlet 31*a* closed. Upon generation of the ON signal from the lid switch 41, the lid opener operation switch 42 is requested to release the holding state of the fuel lid 37. If the lid open signal is received by the lid opener operation switch 42 from the ECU 4 or a predetermined opening operation is performed with respect to the lid manual operation device 43, the lid opener operation switch 42 serves to temporarily release the holding state of the fuel lid 37. The urging force in the opening direction is applied to the fuel lid 37 by a blade spring. Accordingly when such holding state is released, the fuel lid 37 is brought into an opened state.

In the canister system 1 according to the embodiment, a failure diagnosis tool 5 is connected to the ECU 4 during the engine operation such that a predetermined failure diagnosis is performed. That is, upon receipt of the failure diagnosis signal sent from the failure diagnosis tool 5, the ECU 4 determines whether there is any point that causes the leakage of the evaporated fuel, or diagnoses the respective operations of various valves 16*a*, 17*f*, 14*a* and the motor pump 17*c* while operating those valves and pump in accordance with a predetermined procedure.

The ECU 4 includes functions to execute purge control and to prohibit execution of the purge control. Upon establishment of a predetermined purge condition during the engine operation, the ECU 4 controls an opening/closing operation of the purge VSV 14*a* so as to release the purge VSV 14*a* as aforementioned. The treatment of the evaporated fuel (the evaporated fuel within the canister 11 is introduced into the intake pipe 22) is performed by releasing the purge VSV 14*a*.

Meanwhile, when the OBD pump module 17 is operated for switching or the closing valve 16*a* is switched from the closed state to the opened state during the engine operation, the opening control of the purge VSV 14*a* is prohibited so as to forcibly close the purge VSV 14*a*. The purge prohibition control will be described later.

Treatment of Evaporated Fuel in Canister System

The detailed explanation with respect to the treatment of the evaporated fuel in the above-structured canister system 1 will be described hereinafter.

(1) Parking

When the vehicle is in a parking state (engine is stopped), the closing valve 16*a* is basically held closed. In the state where the closing valve 16*a* is held closed, the communication of the fuel tank 3 with the canister 11 is cut so long as the relief valve 16*b* is closed. In the canister system according to the embodiment, the evaporated fuel is not newly adsorbed in the canister 11 in the parking state so long as the tank internal pressure does not exceed the forward valve opening pressure (for example, 20 kPa). Air is not admitted into the fuel tank in the parking state so long as the tank internal pressure does not become lower than the valve opening pressure (for example, −15 kPa) in the reverse direction of the relief valve 16*b*.

(2) Fuel Supply

When the ON signal is sent to the ECU 4 by operating the lid switch 41 in the stop state of the vehicle (engine is stopped), the ECU 4 is activated so as to open the closing valve 16*a* firstly. If the tank internal pressure is higher than the atmospheric pressure in this case, the evaporated fuel within the fuel tank 3 flows into the canister 11 simultaneously with opening of the closing valve 16*a* such that the activated charcoal within the canister serves to adsorb the evaporated fuel. As a result, the tank internal pressure is decreased to the level around the atmospheric pressure.

When the tank internal pressure of the tank is decreased to the level around the atmospheric pressure, the ECU 4 sends a command signal to the lid opener operation switch 42 requesting to release the holding state of the fuel lid 37. Upon receipt of the command signal, the lid opener operation switch 42 releases the holding of the closed position of the fuel lid 37. This makes it possible to open the fuel lid 37 after the tank internal pressure reaches the level around the atmospheric pressure.

When the opening operation of the fuel lid 37 is allowed as described above, the fuel lid 37 is opened, and then the fuel cap 32 is opened so as to allow supply of the fuel. As the tank internal pressure is decreased to the level around the atmospheric pressure before opening of the fuel cap 32, the evaporated fuel is not discharged to the atmosphere from the inlet 31*a* as the fuel lid 37 is opened.

The ECU 4 holds the closing valve 16*a* in the opened state until the fuel supply is finished (for example, until the fuel lid 37 is closed, the vehicle starts running, or a predetermined period of time elapses after generation of the ON signal from the lid switch 41). This makes it possible to allow the evaporated fuel within the fuel tank 3 upon the fuel supply to flow into the canister 11 through the vapor pipe 12, resulting in good fuel supply. As the flowing evaporated fuel is adsorbed in the canister 11, it is not discharged into the atmosphere.

(3) During Running

During running of the vehicle (including the idle operation of the engine), the control for purging the evaporated fuel that has been adsorbed in the canister 11 is executed upon establishment of a predetermined purge condition. Under the control, the purge VSV 14*a* is duty driven while communicating the canister 11 with the atmosphere by switching the switching valve 17*f* of the OBD pump module 17 to OFF. When the purge VSV 14*a* is duty driven as described above, the negative pressure of intake air in the intake pipe 22 is introduced into the canister 11. As a result, the evaporated fuel within the canister 11 is purged into the intake pipe 22 together with air that has been introduced from the atmospheric introduction pipe 13.

The canister system 1 according to the embodiment may be structured to have the canister 11 for adsorbing the evaporated fuel that is limited to the one flowing out of the fuel tank 3 upon the fuel supply. This makes it possible to realize the good exhaust emission and good fuel supply while reducing the size of the canister 11.

Prohibition of Purging Upon Diagnosis

The prohibition of purging upon diagnosis as the characteristic operation according to the embodiment will be described. The embodiment in which the purging to be executed upon diagnosis in the vehicle manufacturing process (diagnosis with respect to the error in the pipe assembly or leakage out of the pipe) will be described.

Figure 3:
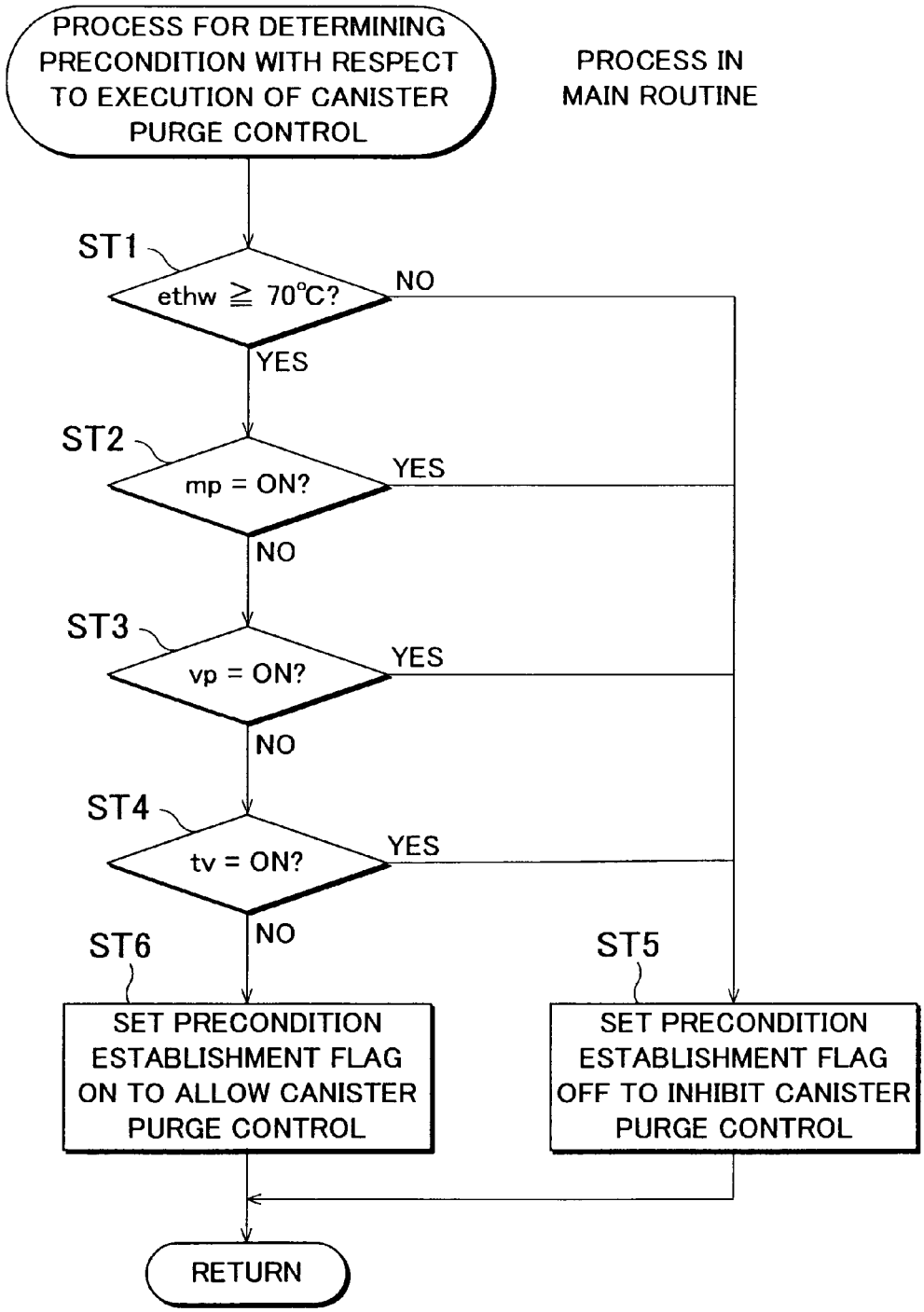
FIG. 3 is a flowchart showing a purge prohibition control process upon diagnosis of the canister system.

The canister system 1 according to the embodiment is structured to prohibit execution of the opening control of the purge VSV 14*a* so as to be forcibly closed when the OBD pump module 17 is switched, or the state of the closing valve 16*a* is switched from the closed state to the opened state during the engine operation. Upon the above-described switching operation, a precondition establishment flag which represents whether execution of the purge control is allowed is set to OFF. Accordingly the opening control of the purge VSV 14*a* is prohibited Hereinafter the aforementioned control will be explained referring to the flowchart of FIG. 3. The control is executed at every rotation of a crank shaft of the engine at a predetermined angle. First in step ST1, an engine cooling water temperature (ethw) is detected by a not-shown temperature sensor. Then it is determined whether the detected temperature is equal to or higher than 70° C. If the engine cooling water temperature is lower than 70° C. (NO is obtained in step ST1), the process proceeds to step ST5 where the precondition establishment flag is set to OFF. More specifically, execution of the opening control of the purge VSV 14*a* is prohibited so as to be forcibly closed. Such control is executed in order to avoid the case in which the engine operation state becomes unstable owing to purging of the evaporated fuel into the intake pipe 22 in the state where the warm-up of the engine has not been finished.

If the engine cooling water temperature is equal to or higher than 70° C. (YES is obtained) in step ST1, the process proceeds to step ST2 where it is determined whether the motor pump (mp) 17*c* of the OBD pump module 17 has been forcibly driven. If it is determined that the motor pump 17*c* is forcibly driven (YES is obtained in step ST2), the process proceeds to step ST5 where the precondition establishment flag is set to OFF. More specifically, the opening control of the purge VSV 14*a* is prohibited so as to be forcibly closed.

If it is determined that the motor pump 17*c* is stopped (NO is obtained) in step ST2, the process proceeds to step ST3 where the switching valve (vp) 17*f* of the OBD pump module 17 has been forcibly switched to ON. If it is determined that the switching valve 17*f* has been forcibly switched to ON (YES is obtained in step ST3), the process proceeds to step ST5 where the precondition establishment flag is set to OFF. That is, the opening control of the purge VSV 14*a* is prohibited so as to be forcibly closed.

Meanwhile if it is determined that the switching valve 17*f* has been in OFF state in step ST3 (NO is obtained), the process proceeds to step ST4 where it is determined whether the closing valve (tv) 16*a* of the closing valve unit 16 has been forcibly opened. If it is determined that the closing valve 16*a* has been forcibly opened (YES is obtained in step ST4), the process proceeds to step ST5 where the precondition establishment flag is set to OFF. More specifically, the opening control of the purge VSV 14*a* is prohibited so as to be forcibly closed.

If it is determined in step ST4 that the closing valve 16*a* has been closed (NO is obtained), that is, the engine cooling water temperature is equal to or higher than 70° C., the motor pump 17*c* is stopped, the switching valve 17*f* is in OFF state, and the closing valve 16*a* is closed, the process proceeds to step ST6 where the precondition establishment flag is set to ON. In other words, when the ECU 4 allows execution of the opening control of the purge VSV 14*a*, and the predetermined purge condition is established, the purge VSV 14*a* is opened.

In the canister system 1 according to the invention, if at least one of the following conditions is established, that is, in the state where the motor pump 17*c* is forcibly driven, the switching valve 17*f* is forcibly switched to ON, and the closing valve 16*a* is forcibly opened, execution of the opening control of the purge VSV 14*a* is prohibited so as to be forcibly closed. This makes it possible to prevent the evaporated fuel within the fuel tank 3 from being directly introduced into the intake system 2, and the density of the fuel of the mixture introduced into the combustion chamber of the engine from being excessively high, thus maintaining the stable engine operation state.

Other Embodiment

In the embodiment as described above, the invention is applied to the canister system 1 of seal type having the closing valve 16*a*. The invention is not limited to the one as aforementioned, but it may be structured such that the canister system of open type having no closing valve 16*a* forcibly closes the purge VSV 14*a* upon switching operation of the OBD pump module 17.

In the embodiment, execution of the purge control is prohibited upon establishment of predetermined conditions during diagnosis in the vehicle manufacturing process. In other words, such control is executed during the idling operation of the engine. The invention is not limited to the one as aforementioned but may be applied to the case where the diagnosis is performed under the negative pressure of the intake air in the engine during running of the vehicle.

The canister system 1 according to the embodiment is provided with the canister 11 that adsorbs the evaporated fuel. The canister system 1 according to the invention, however, does not have to be provided with such component as the canister 11.

In the canister system 1 according to the embodiment, the canister 11 is provided outside of the fuel tank 3. The canister system 1 may be structured as an in-tank canister system, in which the canister 11 is provided within the fuel tank 3.

What is claimed is:

1. An evaporated fuel treatment device of an internal combustion engine comprising:

an evaporated fuel introduction passage through which an evaporated fuel generated within a fuel tank is introduced into an intake system of the internal combustion engine;

a relief valve that is opened when an internal pressure of the fuel tank becomes higher than an internal pressure of the evaporated fuel introduction passage by a predetermined value or greater so as to allow the evaporated fuel within the fuel tank to be introduced into the evaporated fuel introduction passage;

a diagnosis module capable of switching between a communication state in which the evaporated fuel introduction passage is communicated with an atmosphere and a non-communication state in which the evaporated fuel introduction passage is not communicated with the atmosphere;

a purge control valve that is opened so as to allow the evaporated fuel to be introduced into the intake system of the internal combustion engine; and a controller that opens the purge control valve when a predetermined purge condition is established during an operation of the internal combustion engine, wherein the controller prohibits the purge control valve from opening so as to be in a closed state when the diagnosis module is switched to be in the non-communication state in which the evaporated fuel introduction passage is not in communication with the atmosphere during the operation of the internal combustion engine.

2. The device according to claim 1, wherein:

the diagnosis module includes a switching valve that is capable of switching between the communication state in which the evaporated fuel introduction passage is communicated with the atmosphere and the non-communication state in which the evaporated fuel introduction passage is not communicated with the atmosphere; and the controller prohibits the purge control valve from opening so as to be in the closed state when the switching valve is operated to switch from the communication state to the non-communication state.

3. The device according to claim 1, wherein:

the diagnosis module includes a pump that is driven to introduce a negative pressure into the evaporated fuel introduction passage; and the controller prohibits the purge control valve from opening so as to be in the closed state when an operation of the pump is switched from a stopped state to a driven state.

4. The device according to claim 1 further comprising a canister that adsorbs the evaporated fuel, the canister being connected to the fuel tank via a vapor passage, connected to the intake system of the internal combustion engine via a purge passage, and communicated with the atmosphere via an atmospheric introduction passage, wherein the relief valve is provided in the vapor passage, the purge control valve is provided in the purge passage, and the diagnosis module is provided in the atmospheric introduction passage.

5. An evaporated fuel treatment device of an internal combustion engine comprising:

an evaporated fuel introduction passage through which an evaporated fuel generated within a fuel tank is introduced into an intake system of the internal combustion engine;

a closing valve that is opened so as to allow the evaporated fuel within the fuel tank to be introduced into the evaporated fuel introduction passage;

a purge control valve that is opened so as to allow the evaporated fuel to be introduced into the intake system of the internal combustion engine; and a controller that opens the purge control valve when a predetermined purge condition is established during an operation of the internal combustion engine, wherein the controller prohibits the purge control valve from opening so as to be in a closed state when the closing valve is switched from a closed state to an opened state upon diagnosis performed under a negative pressure of an intake air from the intake system during an operation of the internal combustion engine.

6. The device according to claim 5 further comprising a canister that adsorbs the evaporated fuel, the canister being connected to the fuel tank via a vapor passage and connected to the intake system of the internal combustion engine via a purge passage, wherein the closing valve is provided in the vapor passage and the purge control valve is provided in the purge passage.

7. A method of treating an evaporated fuel of an internal combustion engine comprising an evaporated fuel introduction passage through which an evaporated fuel generated within a fuel tank is introduced into an intake system of the internal combustion engine, a closing valve that is opened to allow the evaporated fuel within the fuel tank to be introduced into the evaporated fuel introduction passage, a diagnosis module capable of switching between a communication state in which the evaporated fuel introduction passage is communicated with an atmosphere and a non-communication state in which the evaporated fuel introduction passage is not communicated with the atmosphere, and a purge control valve that is opened so as to allow the evaporated fuel to be introduced into the intake system of the internal combustion engine, the method comprising:

executing a control for opening the purge control valve when a predetermined purge condition is established during an operation of the internal combustion engine; and prohibiting execution of the control for opening the purge control valve so that the purge control valve is in a closed state when the diagnosis module is switched to be in the non-communication state, or when the diagnosis module operates a pump during the operation of the internal combustion engine and a closing valve is switched from a closed state to an opened state during a diagnosis performed under a negative pressure of an intake air from the intake system.

8. The method according to claim 7, wherein:

the diagnosis module includes a switching valve that is capable of switching between the communication state in which the evaporated fuel introduction passage is communicated with the atmosphere and the non-communication state in which the evaporated fuel introduction passage is not communicated with the atmosphere; and execution of the control for opening the purge control valve is prohibited so that the purge control valve be in the closed state when the switching valve is operated to switch from the communication state to the non-communication state.

9. The method according to claim 7, wherein:

the pump of the diagnosis module is driven to introduce a negative pressure into the evaporated fuel introduction passage; and the execution of the control for opening the purge control valve is prohibited so that the purge control valve be in the closed state when an operation of the pump is switched from a stopped state to a driven state.

* * * * *